United States Patent [19]

Johnson

[11] 4,260,336

[45] Apr. 7, 1981

[54] COOLANT FLOW CONTROL APPARATUS FOR ROTATING HEAT EXCHANGERS WITH SUPERCRITICAL FLUIDS

[75] Inventor: Bruce V. Johnson, Manchester, Conn.

[73] Assignee: United Technologies Corporation, Hartford, Conn.

[21] Appl. No.: 972,183

[22] Filed: Dec. 21, 1978

[51] Int. Cl.[3] ..... F01D 5/08; F01D 5/18

[52] U.S. Cl. ..... 416/96 R; 416/96 A

[58] Field of Search ..... 416/96 R, 96 A, 97 R, 416/97 A

[56] References Cited

U.S. PATENT DOCUMENTS

| | | | |
|---|---|---|---|
| 2,073,605 | 3/1937 | Belluzzo | 416/96 |
| 2,447,292 | 8/1948 | Van Acker | 416/96 |
| 2,647,368 | 8/1953 | Triebbnigg et al. | 416/96 A |
| 2,778,601 | 1/1957 | Eckert | 416/96 |
| 2,812,157 | 11/1957 | Turunen et al. | 416/96 |
| 2,815,926 | 12/1957 | Walker | 416/96 |
| 2,883,151 | 4/1959 | Dolida | 416/96 |
| 2,883,152 | 4/1959 | Turunen et al. | 415/114 |
| 3,446,481 | 5/1969 | Kydd | 416/96 |
| 3,706,508 | 12/1972 | Moskowitz et al. | 416/96 A |
| 3,736,071 | 5/1973 | Kydd | 416/97 |
| 3,804,551 | 4/1974 | Moore | 416/96 |
| 3,841,786 | 10/1974 | Florjancic | 415/114 |
| 3,849,025 | 11/1974 | Grondahl | 416/97 |
| 3,902,819 | 9/1975 | Holchendler et al. | 416/96 |
| 4,118,145 | 10/1978 | Stahl | 416/96 |
| 4,156,582 | 5/1979 | Anderson | 416/96 |

*Primary Examiner*—William L. Freeh

*Attorney, Agent, or Firm*—Harry J. Gwinnell

[57] ABSTRACT

The disclosed invention relates to coolant flow control apparatus for rotating heat exchangers such as used with a liquid cooled turbine blade and disc. By employing a combination of inlet and outlet orifices in the constrained coolant path of the apparatus, the liquid coolant can be made to rapidly reach and maintain supercritical temperature and pressure in the heat exchanger over a range of coolant heat absorption rates.

3 Claims, 5 Drawing Figures

COOLANT FLOW CONTROL APPARATUS FOR ROTATING HEAT EXCHANGERS WITH SUPERCRITICAL FLUIDS

BACKGROUND OF THE INVENTION

1.Field of the Invention

The field of art to which this invention pertains is fluid reaction surfaces with cooling means utilizing fluid flow through the working member.

2. Description of the Prior Art

Various means have been used to cool rotating heat exchangers such as used with turbine blades by passing liquid coolant through the blade. For example, U.S. Pat. No. 4,118,145 uses a channeled blade wherein the coolant is projected against a collection surface and the coolant is passed through the blade from the collection surface by virtue of centrifugal force. However, no means are disclosed in such system for metering or controlling the amount of flow into and out of the blade or for attaining the supercritical pressures and temperatures desired. Similarly, U.S. Pat. No. 2,647,368 describes a system of projecting coolant against a collection surface which is subsequently forced through the turbine blade by centrifugal force. Again, there are no provisions in this latter patent for metering or controlling both the inlet and exhaust of the coolant to take into account variances from blade to blade from a central coolant source to provide such things as supercritical pressures and temperatures in the system.

It has also been proposed to use a single orifice coolant control system for turbine blades (e.g., U.S. Pat. No. 3,902,819). The primary problem with such systems is that it is difficult to reach the desired situation in the turbine blade where the coolant is present in the turbine engine assembly and in the blades in particular at supercritical temperature and pressure. For a flow control system with a pressure controlled inlet and a single orifice at the outlet the coolant discharge would not reach supercritical temperatures and the flow rate would be five times what is necessary to cool the blade with supercritical temperatures for the coolant discharge. With the present invention, much greater control can be exercised in coolant flow rates resulting in the attainment and maintenance of supercritical temperatures and pressures at the coolant discharge location with minimal time lag.

Accordingly, the present invention provides an engine assembly with a flow control system for use with fluid cooled turbine blades, and especially water cooled turbine blades, which provides metering inlet and outlet orifices in the turbine disc, thereby achieving supercritical temperature and pressure of the coolant in the blades.

BRIEF SUMMARY OF THE INVENTION

This invention contemplates a system and apparatus for controlling the flow rate through a rotating heat exchanger such as used for cooling turbine blades with a coolant, such as water, in a supercritical state. The system includes a liquid coolant source feeding a plurality of inlet orifices in a rotating apparatus such as a turbine disc. The rotating apparatus contains a plurality of individual coolant supply conduits and coolant exhaust conduits containing coolant discharge orifices. The inlet and exhaust orifices are of such size and the inlet orifice so placed on the radius of rotation of the rotating apparatus that a liquid-vapor interface is formed in the coolant supply duct thus maintaining supercritical liquid coolant in the rotating heat exchangers.

The foregoing and other objects, features and advantages of the present invention will become more apparent in light of the following detailed description of preferred embodiments thereof as discussed and illustrated in the accompanying drawing.

DESCRIPTION OF THE PREFERRED EMBODIMENT

Figure 1:
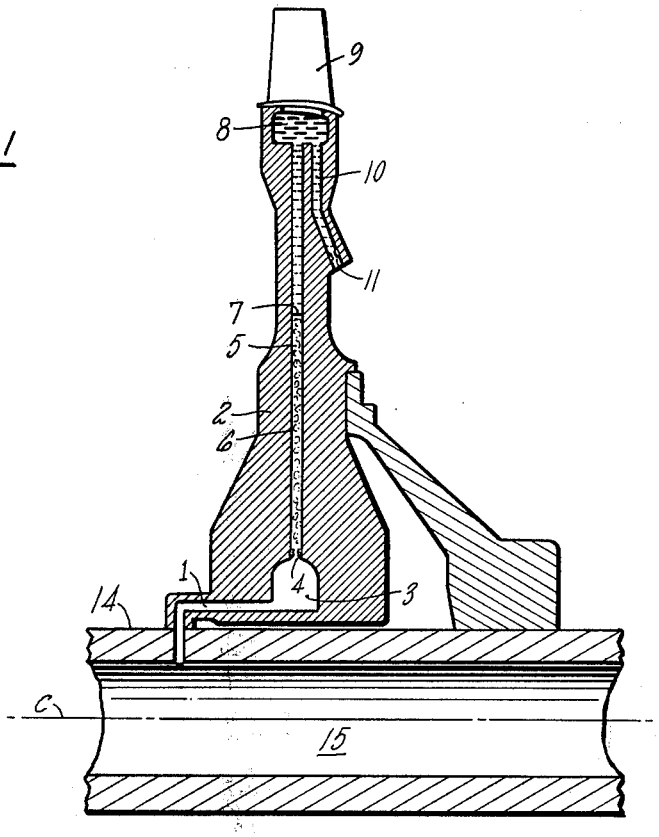
FIG. 1 shows a typical embodiment of a liquid cooled turbine blade engine subassembly using the flow control system described.

As stated above this invention is directed to a flow control system for a rotating heat exchanger, such as a liquid cooled engine assembly, comprising a coolant supply source, a rotating disc, and heat exchangers such as turbine blades having internal coolant conduits.

While this invention has particular applicability to liquid cooled turbine blade assemblies, it is also applicable to controlling the flow through other rotating heat exchangers such as employed with superconducting electrical generators cooled with helium or hydrogen at supercritical pressures or rotating apparatus cooled with fluorocarbon compounds at supercritical pressure and temperature.

The coolant is preferably a conventional deionized water. The coolant supply systemn employs a single stationary feedline which feeds the coolant to the rotating disc. The total flow through this system can be controlled by varying the pressure of the fluid supplied to the disc, or by metering the total coolant flow rate to the disc, depending on the specific embodiment of the supply system.

The rotating disc has a system of coolant supply ducts leading to the coolant supply ducts in each individual blade or other heat exchanger and a coolant exhaust duct leading from each coolant supply duct in each individual blade or other heat exchanger. Thus, there is a pair of coolant ducts in the disc for each turbine blade or other heat exchanger, the total number of ducts in the disc being equal to twice the number of turbine blades or other heat exchangers. The disc is adapted to be mounted on a shaft for rotation therewith and the disc may have formed around its periphery a plurality of equally spaced turbine blade retention slots for retaining the above cited turbine blades or other heat exchangers.

The turbine blades or other heat exchangers could be an integral part of the disc by virtue of being cast along with the disc or can be separately made and attached to the disc after their respective separate manufacture, by welding, adhesive bonding, mechanical interengagement, etc. The blades or other heat exchangers can have any conventional flow coolant passage design which provides sufficient passages in the blade or other heat exchanger to produce the desired cooling action. Note e.g. U.S. Pat. No. 3,902,819, incorporated by reference. Note also FIG. 5.

The inlet orifice is positioned at the coolant supply conduit opening, being at small enough radius from the rotational center of the rotating apparatus such as an engine assembly to produce a liquid-vapor interface in the disc coolant supply conduit such that only super-critical pressure coolant is present in the coolant conduits in the turbine blade or other heat exchanger itself under normal operating conditions. The super-critical pressure is caused by a pumping action of the disc on the water from the liquid vapor interface to the blade. This is accomplished in conjunction with the disc coolant exhaust orifice.

The disc coolant exhaust orifice is positioned at a radius above that of the inlet orifice, i.e., further from the rotational center of the rotating apparatus such as an engine assembly, to insure flow of the coolant in the proper direction in the assembly, through the inlet orifice, through the turbine blade or other heat exchanger and through the exhaust orifice.

The disc can be so designed to include a plurality of inlet plenums upstream of the inlet orifices to regulate the flow rate across the inlet orifices.

Not only does this system provide coolant in the turbine blades or other heat exchangers under supercritical conditions virtually from rotating apparatus or engine start-up by initially restricting the flow of coolant until the desired supercritical conditions are produced in a constant equilibrium condition, but supercritical conditions can be sustained in the blades or other heat exchangers over a range of coolant heat absorption rates by regulating the coolant pressure against the inlet orifice.

The coolant passages in the disc can be the same material as the disc, e.g., simply drilled conduits, or inserts, or coated passages. The key is, of course, that the passages or material they are made of is corrosion resistant and able to withstand prolonged exposure to the coolant at high temperature and pressure. Nickel and cobalt containing superalloys such as the Inconel ® (International Nickel Co. Inc.) and Hastelloy ® (Cabot Corp.) family of alloys meet these requirements. The inlet and exhaust orifice material should at least have the same corrosion resistant properties as the disc coolant passages. The above cited alloys meet these requirements as do the alumina containing ceramics such as Lucalox ® (General Electric Co.) and yttria containing ceramics such as Yttralox ® (General Electric Co.).

In the instant invention, it has been found that by combining this central coolant source with inlet and outlet metering orifices that very fine tuning can be impressed on the coolant system. Regardless of the supply system design, substantial temperature and pressure control on the coolant system can be impressed by virtue of the interaction of the continuously open inlet orifice and continuously open outlet orifice and optionally a coolant collection surface plenum.

By being able to exercise significant control on the coolant flow within the turbine blade or other heat exchanger, the coolant outlet pressure and temperature can be finally controlled. Such control has significant effects on the amount of heat which can be absorbed by the coolant. This, for example, can have a significant effect on the problem of bringing a turbine blade or other heat exchanger to operating temperature quickly, by controlling the coolant discharge temperature to be supercritical.

Where a plenum coolant collection type surface is employed with the inlet orifice being positioned radially outward from the coolant collection surface, this allows additional flexibility in the design of the flow control system, by allowing variable pressures to be imposed on the inlet orifice to allow for different coolant heat absorption rates. It is important with the metered inlet flow system of this invention that the inlet orifice metering the flow to the blade be positioned at a small enough radius from the rotational center line that sufficient pressure rise due to centrifugal force is available to compress the coolant fluid to the desired pressure at the rotating apparatus or turbine operational rate, since it is important that the coolant in the blades or other heat exchangers be at supercritical pressure to provide a sufficient cooling action and avoid boiling. By use of the dual orifice approach of the invention, the cooling should be stable to small perturbations. And the heat absorption rate of the system may vary with various design considerations.

The operating characteristics for any particular system would depend on the diameter of the discharge orifice, the blade or other heat exchanger heat absorption rate, the coolant flow rate and the diameter of the inlet orifice. Accordingly, as demonstrated by the figures, there is a definite correlation between discharge temperature and pressure with heat absorption and coolant flow rate. If subcritical pressures resulting in coolant boiling and two-phase flow occur during start up of the rotating heat exchanger or turbine system and if boiling during start up is deemed unacceptable, this problem can be overcome by varying the position of the discharge orifice, i.e., positioning the discharge orifice at a radius closer to the inlet radius.

In FIG. 1, a typical embodiment of the flow control system of the present invention is shown. While any conventional coolant can be used in the system, water is the preferred coolant because of, for example, its heat absorption characteristics. One of a plurality of liquid coolant feed lines 1 projectingg into rotating turbine disc 2, off of shaft 14, provides a constant flow of coolant such as water to plenum 3. The pressure of this coolant built up in the plenum 3 is caused by the centrifugal force of the rotating turbine assembly and the inlet pressure in the shaft. The flow rate across inlet orifice 4 is caused by the pressure difference between plenum 3 and duct 6. This orifice is made of a material which can be the same or different from the rest of the assembly and is preferably a high temperature stable and corrosion resistant metal alloy or ceramic such as mentioned above. The opening of the inlet orifice varies, depending on the specifications of the turbine system in whch it is used but typically is an annular opening of about 0.06 inch jdiameter. The pressure of the water droplets and water vapor 5 as they enter the blade water supply duct 6 is usually 50 to 200 psi depending on the saturation pressure of the coolant at the highest coolant temperature between the inlet orifice and the liquid-vapor interface. The pressure rise from the water-vapor interface to the blade coolant manifold, usually 3500 to 5000 psi, is caused by the centrifugal forces on the water rotating in the disc. The herein described system supplies water at a sufficient flow rate to maintain a water-vapor interface in the blade water supply duct. The flow rate across orifice 4 is regulated for various coolant heat loads by regulating the pressure in the supply shaft conduit 15. This provides a means for metering the total coolant flow to the disc. As stated above, the water as it enters the blade water supply duct 6 through inlet orifice 4 passes through a vapor region in the supply duct at approximately the saturation pressure of the water forming a liquid-vapor interface 7. The water is compressed in the duct 6 by centrifugal forces to higher pressures as it flows radially outward from the liquid-vapor interface 7 compressed into supercritical pressure water 8 and finally passing into the water cooled turbine blade 9.

The system requires that the inlet orifice 4 metering the flow to the blade be positioned at a small enough radius r from the rotational center line of the engine assembly c that sufficient pressure rise due to the centrifugal forces of the system is available to compress the fluid to the desired pressure at a turbine operational rate. Further control on the temperature of the coolant in the system and the pressure obtainable in the system is exercised by inclusion in the turbine disc 2 at the end of the blade water exhaust duct 10 of a discharge orifice 11 of predetermined diameter, again depending on the pressures, temperatures, and heat absorption rates desired in a particular system. Accordingly, the blade coolant discharge temperature can be further controlled by such things as the inlet manifold pressure, the inlet orifice diameter, heat flux to the blade, and outlet orifice diameter and radial location. While the diameter of the discharge orifice will vary depending on such things as the design heat flux to the blade, typically such diameters are about 0.04 inch. In general, the inlet flow rate will be a function of the pressure difference between the inlet water pressure and the inlet water saturation pressure and the inlet orifice diameter and shape.

EXAMPLE 1

Figure 2:
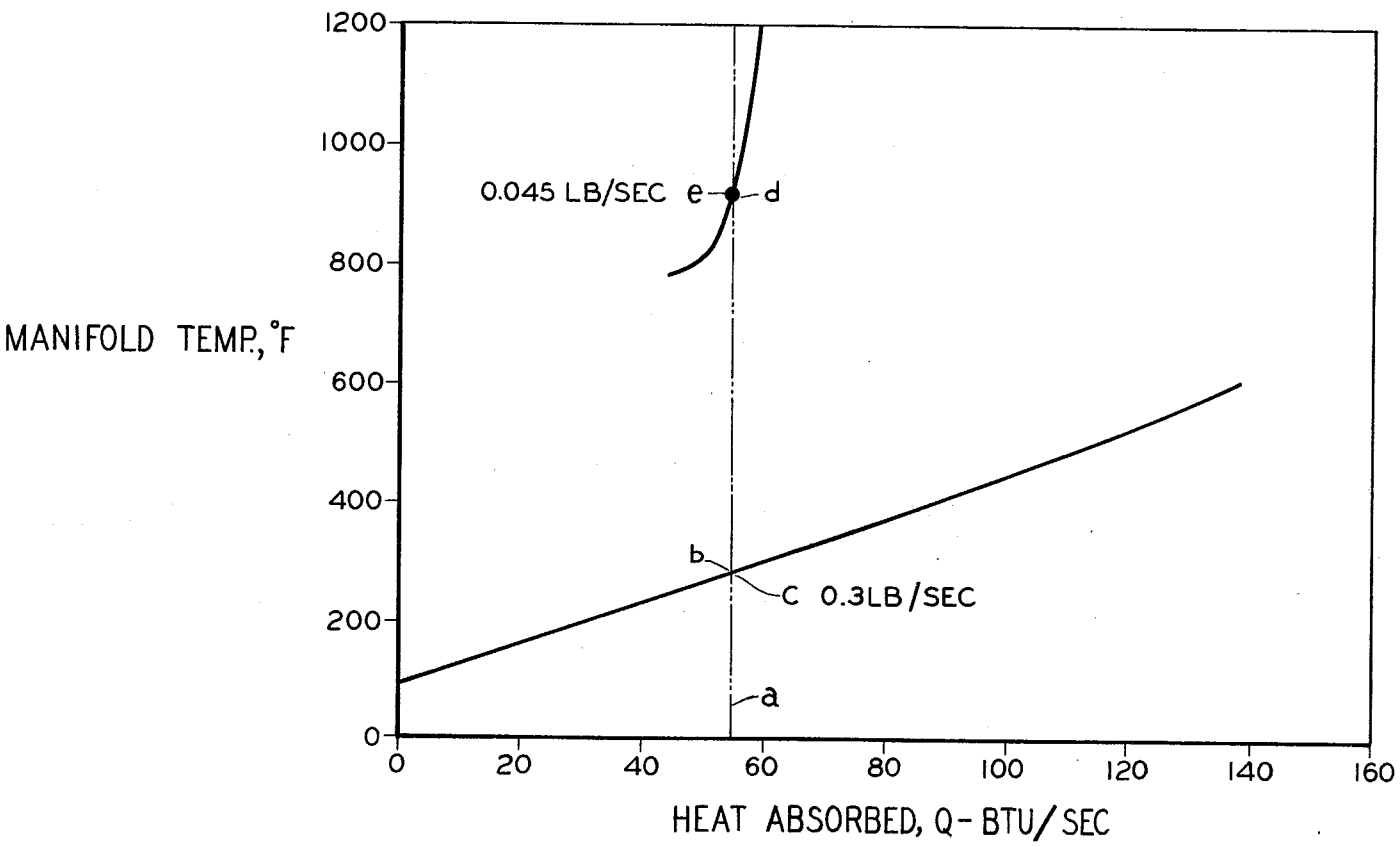
FIGS. 2 and 3 demonstrate the variation of heat absorbed by water with different coolant outlet temperatures.

In an exemplary system a water feedline near the center of rotation of a turbine system was set up to supply as much water as required by each blade in a multi-blade arrangement at pressures of approximately 200 psi. A transfer duct carried the water radially outward to each blade utilizing only an exit orifice to control the outlet temperature of the coolant. The discharge pressure was 4000 psi. The outlet orifice had a size of 0.001 $inch^2$ and the coolant had an inlet temperature of 100° F. For purposes of calculation, for discharge temperatures less than 600° F., the flow through the exit orifice was assumed to be incompressible. Again, for calculation purposes, for discharge temperatures above 800° F., the flow was assumed to be compressible and isentropic. It should be noted that orifice flow near the critical temperature in this system would be a two-phase flow, gaseous and liquid, through the orifice. These two-phase flow rates are not calculated. The results of the calculations based on this system are shown in FIG. 2. For typical blade heat absorption rate of 55 BTU/SEC (a), there are two stable coolant discharge temperatures: approximately 300° F. (b) with a coolant flow rate of 0.3 pound per second (c) and 915° F. (d) with a coolant flow rate of 0.045 pound per second (e). If the water supply system is a demand system, supplying as much as required by the system at a given pressure, the flow rate remains approximately constant as the turbine blade heat load increases from start-up. However, the coolant discharge temperature increases almost linearly with heat load to 600° F. Thus, as can be seen by this example, to obtain supercritical temperature discharge conditions it is necessary to further control the flow rate to the blade.

EXAMPLE 2

Figure 3:
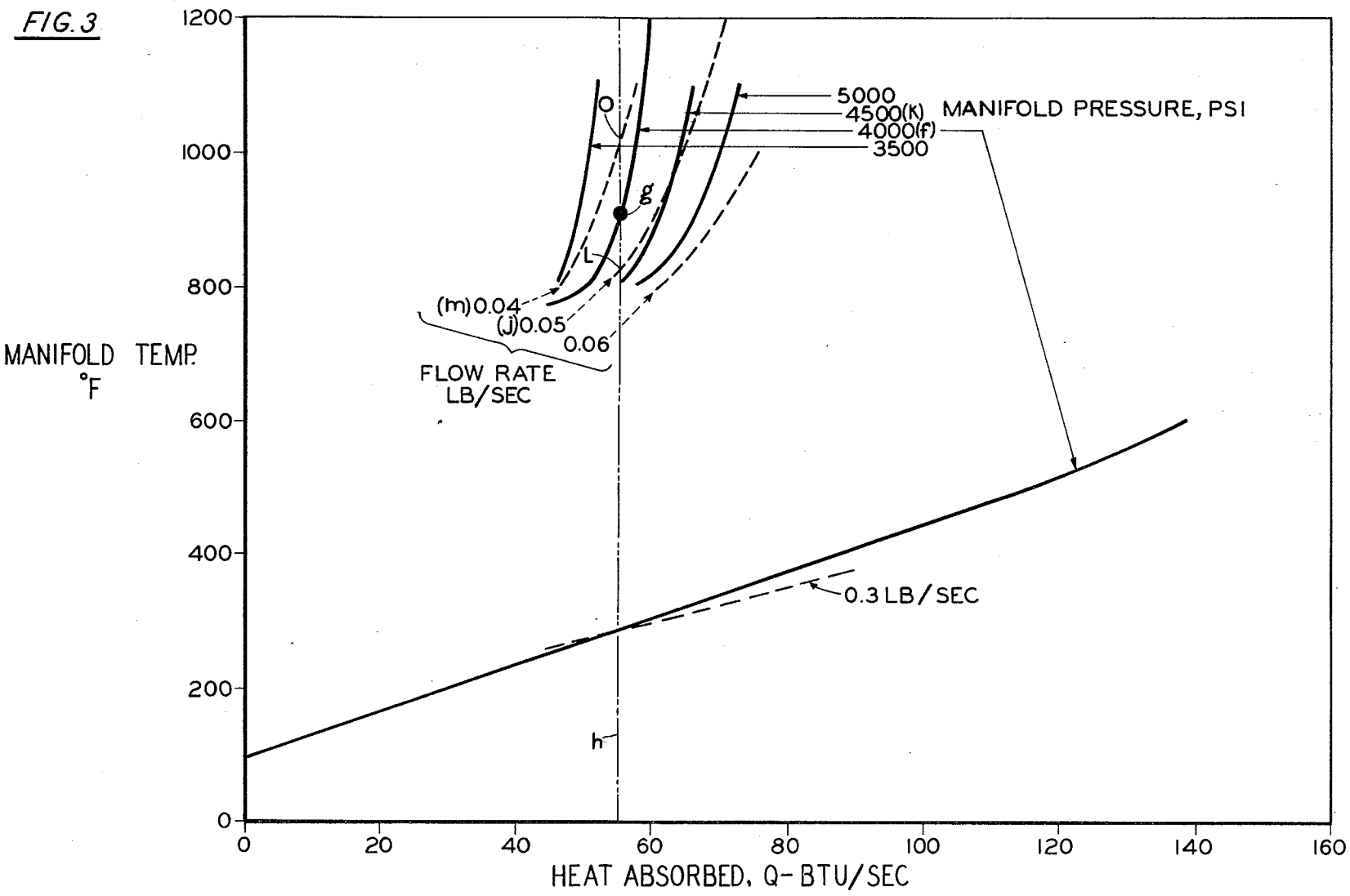

This example demonstrates the operating characteristics of a flow control system using both a discharge orifice and a metered inlet flow. The coolant is metered to the blade water supply duct through an orifice, for example as shown in FIG. 1. The coolant flows radially outward along the tube wall through vapor at approximately the inlet saturation pressure until a water-gas interface is reached. A column of water vapor and a stream of water drops will occur radially between the inlet metering orifice and the water vapor interface as shown for example in FIG. 1. The coolant pressure increases from that radius to the blade manifold radius by the centrifugal forces on the coolant. The control system requires that the metering orifice be positioned at small enough radius such that the pumping pressure is available. The radius of the water-vapor interface will depend on the blade discharge pressure. Thus, the blade coolant discharge conditions for this flow control system are determined by the blade heat absorption rate, the coolant flow rate, and the orifice diameters. The operating characteristics for this system with metered flow are shown in FIG. 3 over a range of pressures and flow rates. The flow rate required to obtain a 4000 (f) psi, 915° F. (g) exit manifold condition with heat absorption rate of 55 BTU per second is 0.045 pound per second. Increasing the flow rate to 0.050 (j) pound per second increases the manifold pressure to 4400 psi and decreases the discharge temperature to 830° F. (l). Likewise, decrease in the flow rate to 0.040 (m) pound per second causes the pressure to drop to 3800 psi and the temperature to rise to approximately 1030° F. (o). For the system enumerated in FIG. 3, the variation of discharge temperature and pressure with heat absorption and coolant flow rates can be determined for a range of operating conditions, hitherto unobtainable with similar prior art systems. Another variable which can be used to control pressures and temperatures in the system is the relative placement of the discharge and inlet orifices. For example, to avoid subcritical coolant pressures during turbine blade start-up, the discharge orifice could be positioned at a radius close to the inlet radius to avoid this problem.

While the aforementioned examples were carried out with turbine blades, the problem illustrated by Example 1 and the solution demonstrated by Example 2 are exemplary of problems and solutions applicable to other rotating heat exchangers using fluids at supercritical temperatures and pressures.

Another advantage of this system in gas turbines is that in its preferred embodiment the supercritical coolant will be exhausted so as to purge the cavity between the blades and the vanes, which in some prior art systems was purged with air bled off the compressor, for example.

Figure 4:
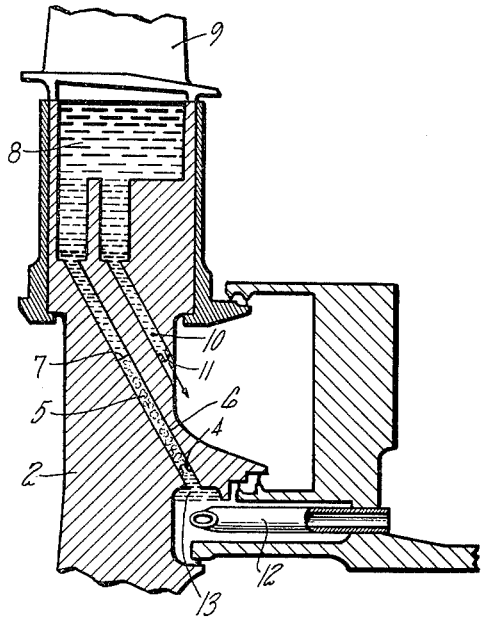
FIG. 4 shows an engine assembly of the present invention including a coolant supply source producing an additional vapor-liquid interface upstream of the inlet orifice.

An alternative water feed system is shown by FIG. 4. In this figure, characters 2 and 4 to 11 have the same designation as in FIG. 1. According to this embodiment, the coolant supply source employs a plurality of nozzles, as illustrated by character 12, fed by stationary supply ducts not in the shaft as in FIG. 1 but separately mounted to project coolant against the plenum 13 forming a separate liquid-vapor interface at the plenum 13 upstream of the inlet orifice 4. The total coolant flow to the disc is metered prior to injection through the nozzles. As stated above, this provides additional means to regulate the flow rate across the inlet metering orifice to provide the desired supercritical coolant condition in the blades. Baffles to prevent wave formation can be included in the inlet plenums 13. While the flow control system of the present invention can be used with many varieties of coolant supply sources, two preferred types are (1) a pressurized all liquid coolant supply source supplying coolant across the inlet orifice in liquid form from a liquid coolant source conduit as shown in FIG. 1. With this system, the coolant remains liquid prior to reaching the inlet orifice, and no liquid-vapor interface is formed upstream of the inlet orifice, and (2) a stationary-to-disc type coolant supply source as shown by FIG. 4 producing a liquid-vapor interface upstream of the inlet orifice. Coolant supply conduits in this latter embodiment comprise at least one and preferably 6 to 12 coolant ejecting nozzles located to eject or squirt coolant preferably in the direction of disc rotation against one or more plenums upstream of the inlet metering means.

Figure 5:
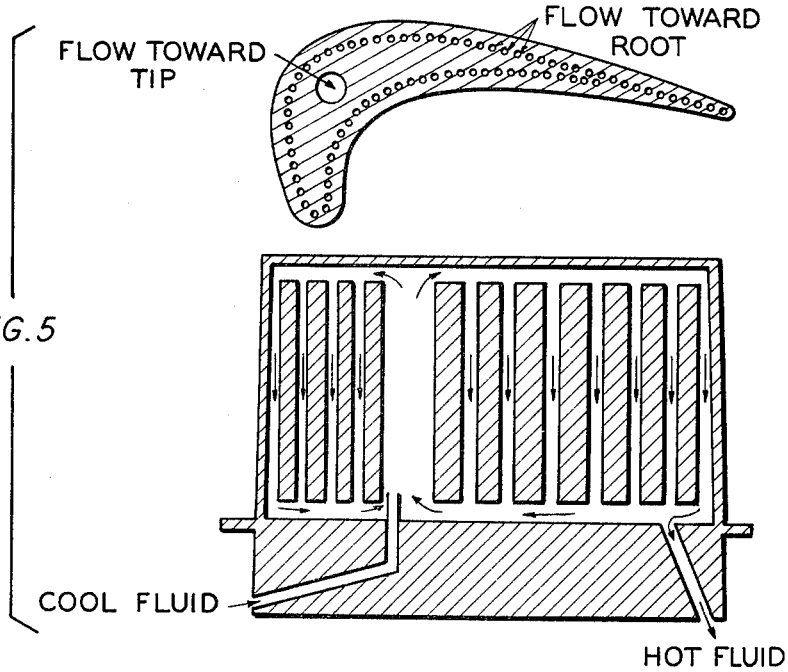
FIG. 5 shows a cross section of a typical liquid cooled turbine blade for use in the present invention and a sketch of the thermo-syphon path of the coolant in the blade.

A typical coolant blade design useful in the system is shown by FIG. 5 with flow shown as described in the figure. This figure demonstrates schematically flow through a system similar to that of U.S. Pat. No. 3,902,819 which, as stated above, is incorporated by reference.

As stated above, the orifice diameters both on the inlet and exit orifices will vary depending upon the temperatures and pressures desired and such things as the design heat flux to the blade. However, in general, orifices with diameters from 0.025 to 0.100 inch are typical.

It can be seen from the above, that more flexibility in the design of a flow control system for rotating heat exchangers with coolant at supercritical pressures and temperatures can be obtained by practice of the present invention. By positioning the inlet orifice radially outward from the coolant collection surface and metering the coolant flow supply to each disc in a multiple turbine blade or other heat exchanger assembly with a single coolant supply, flow rates can be varied with differing rotating apparatus or turbine operating conditions to a much greater degree than ever possible in the prior art. The inlet orifices should preferably be at the same radius from the coolant supply nozzle for each blade and should be manifolded together immediately upstream of the inlet orifice radius.

The metered inlet flow control system for water cooled turbine blades also overcomes the problem of bringing coolant within the water cooled turbine blades up to supercritical operating pressures and temperatures, provides for operation over a reasonable range of gas path conditions, and provides a method for obtaining reasonable uniform blade to blade cooling within a wide range of manufacturing specifications and tolerances and with minimal orifice erosion. In addition, all this is accomplished with no moving parts in the coolant system.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of my invention, that which I claim as new and desire to secure by Letters Patent of the United States is:

1. A rotating apparatus subassembly comprising:

a disc adapted to be mounted on a shaft for rotation therewith having around its periphery a plurality of heat exchangers, the disc having a plurality of internal passages extending radially outward from a coolant fluid inlet to the heat exchangers and a plurality of internal passages extending from the heat exchangers to coolant fluid outlets, the heat exchangers having internal coolant passages in fluid communication with the internal passages in the disc;

a coolant supply source with means for metering the coolant flow rate through the passages extending from the coolant inlet to each heat exchanger comprising a coolant collection surface plenum and a continuously open inlet orifice, and means for metering the coolant flow rate through the passages extending to the coolant outlet from each heat exchanger comprising a continuously open outlet orifice, said metering means for each heat exchanger sized to restrict coolant flow through each heat exchanger to produce supercritical pressure and temperature of the selected coolant within the heat exchanger and passages extending to the coolant outlet over a range of heat exchanger heat fluxes, the metering means for the coolant inlet being sufficiently close to the rotational center line of the disc to produce a coolant liquid-vapor interface in the passages extending from the coolant inlet when the subassembly is at operating equilibrium.

2. The subassembly of claim 1 wherein the disc is mounted on a rotational shaft and the coolant supply source is a conduit in the shaft.

3. The subassembly of claim 1 wherein the selected coolant is water.

* * * * *